US006851937B2

(12) United States Patent
Choi et al.

(10) Patent No.: US 6,851,937 B2
(45) Date of Patent: Feb. 8, 2005

(54) SWASH PLATE TYPE COMPRESSOR HAVING IMPROVED REFRIGERANT DISCHARGE STRUCTURE

(75) Inventors: Jeong-Won Choi, Daejeon (KR); Kweon-Soo Lim, Daejeon (KR); Jang-Soon Shin, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 111 days.

(21) Appl. No.: 10/266,578

(22) Filed: Oct. 9, 2002

(65) Prior Publication Data

US 2003/0068235 A1 Apr. 10, 2003

(30) Foreign Application Priority Data

Oct. 10, 2001 (KR) ..... 2001-62353

(51) Int. Cl.[7] ..... F04B 1/12

(52) U.S. Cl. ..... 417/269; 417/312

(58) Field of Search ..... 417/199.1, 212, 417/215, 221, 222.2, 223, 269, 312, 560; 91/472, 473, 474, 475, 476, 477, 479, 480, 481, 482, 483, 484, 485, 486, 487, 488, 489, 490–507; 92/71, 163; 181/212; 415/1, 21, 11, 13, 51, 110, 175, 177, 179

(56) References Cited

U.S. PATENT DOCUMENTS

| | | | | |
|---|---|---|---|---|
| 4,534,710 A | | 8/1985 | Higuchi et al. | |
| 4,610,604 A | | 9/1986 | Iwamori | |
| 5,795,139 A | * | 8/1998 | Ikeda et al. | 417/269 |
| 5,800,133 A | * | 9/1998 | Ikeda et al. | 417/269 |
| 5,947,698 A | * | 9/1999 | Ikeda et al. | 417/269 |
| 6,068,453 A | * | 5/2000 | Ahn et al. | 417/269 |
| 6,077,049 A | * | 6/2000 | Nakamura et al. | 417/269 |

FOREIGN PATENT DOCUMENTS

| | | |
|---|---|---|
| DE | 10031679 | 1/2001 |
| JP | 10-009134 | 1/1998 |

* cited by examiner

*Primary Examiner*—Charles G. Freay
(74) *Attorney, Agent, or Firm*—Lowe Hauptman Gilman & Berner, LLP

(57) ABSTRACT

A swash plate type compressor includes a front head portion having a suction chamber and a discharge chamber sectioned by a partition wall formed on an inner surface of the front head portion, and having at least one upper discharge guide groove and at least one lower discharge guide groove formed in an upper portion and a lower portion of the discharge chamber, respectively, a rear head portion having a suction chamber and a discharge chamber sectioned by a partition wall formed on an inner surface of the rear head portion, and having at least one upper discharge guide groove and at least one lower discharge guide groove formed in an upper portion and a lower portion of the discharge chamber, respectively, to correspond to the upper and lower discharge guide groove of the front head portion, a cylinder installed between the front and rear head portions or inside the front and rear head portions and having a plurality of bores installed such that pistons are capable of sliding therein, at least one upper discharge passageway and at least one lower discharge passageway for connecting the upper and lower discharge guide grooves of the front and rear head portions, respectively, a drive shaft installed to penetrate the cylinder and rotated by a driving source, and a swash plate installed at the driving shaft to be inclined and having the pistons installed at an end portion of the swash plate. Thus, in the swash plate type compressor, the compressed refrigerant can be quickly discharged with less resistance so that, when the liquid refrigerant is sucked, compression noise can be reduced.

23 Claims, 8 Drawing Sheets

SWASH PLATE TYPE COMPRESSOR HAVING IMPROVED REFRIGERANT DISCHARGE STRUCTURE

BACKGROUND OF THE INVENTION

1. Field of the Invention

The present invention relates to a swash plate type compressor, and more particularly to a swash plate type compressor in which compressed refrigerant is smoothly discharged.

2. Description of the Related Art

In a typical air conditioning system for a vehicle, refrigerant compressed by a compressor is condensed by a condenser and transferred to an expansion valve. The expansion valve makes the refrigerant in form of wet saturated vapor of low temperature and low pressure, and transfers the wet saturated vapor to an evaporator. The evaporator performs heat exchange between the low temperature refrigerant and the outside air so that the refrigerant absorbs the heat of the outside air. Then, the evaporator transfers the refrigerant to the compressor so that the above cycle is repeated.

The compressor used to compress the refrigerant in the air conditioning system for a vehicle sucks the refrigerant vaporized in the evaporator, compresses the sucked refrigerant, and discharges the compressed refrigerant, so that the refrigerant can continuously circulated. The compressor can be classified into a plurality of types such as a swash plat type, a scroll type, a rotary type, and a wobble plate type, according to a driving method.

The swash plate type compressor includes a cylinder having a plurality of bores into each of which a piston is inserted and fixed by front and rear head portions. A driving shaft is installed at the center of the cylinder. A swash plate coupled to the driving shaft is installed in the cylinder where the pistons are installed. As the swash plate rotates, the pistons reciprocate in order in the lengthwise direction of the cylinder.

In the meantime, valve apparatuses for controlling the flow of refrigerant so that the refrigerant is sucked into the cylinder and is discharged to the outside when the refrigerant is compressed by the pistons, is installed between an inner side surface of each of the front and rear head portions and both end portions of the outside of the cylinder.

The refrigerant is sucked into the cylinder by the opening and shutting of the valve apparatus and is compressed by the pistons. The compressed refrigerant is discharged outside the compressor by the valve apparatus.

In the swash plate type compressor, suction chambers by which the refrigerant enters the cylinder after passing the valve apparatus and discharge chambers where the refrigerant compressed by the piston remains are formed at the inner side surfaces of the front and rear head portions. Also, in a fixed volume swash plate type compressor, refrigerant is compressed alternately into the discharge chambers of the front and rear head portions by using dual head pistons where heads are formed in the opposite sides and is discharged. The refrigerant discharged into the discharge chamber of the front head portion is transferred to the rear head portion through a discharge passageway formed between the bores of the cylinder. Here, the refrigerant transferred to the rear head portion is discharged together with the refrigerant discharged from the rear head portion through a discharge port directly connected to the rear head portion, or is discharged through a discharge port of a muffler portion via the muffler portion to an external refrigerant circuit out of the compressor.

Conventionally, since only one discharge passageway through which the refrigerant is transferred from the front head portion to the rear head portion is formed at the upper side of the cylinder, there has been a limit in smoothly transferring the compressed refrigerant from the front head portion.

Also, in an air conditioning system adopting the compressor having the above structure, when a daily temperature range is great, refrigerant in a liquid state may flows in the compressor due to the difference in temperature between a compressor, a condenser, and an evaporator. When the refrigerant in a liquid state enters the compressor, a liquid compression noise is generated at the initial driving of the system. In this case, since the liquid refrigerant compressed in the front head portion is not effectively discharged in the above compressor, noise is not reduced.

To reduce the noise due to the liquid refrigerant, an apparatus such as a solenoid valve for preventing the entrance of the liquid refrigerant into the compressor is provided. However, such an apparatus is expensive and, in the case of malfunction, circulation in the air conditioning system becomes worse and may exert an bad influence on a normal operation.

Japanese Patent Publication No. hei 10-9134 discloses a compressor in which the structure of a muffler is improved so that pulsation of pressure of the refrigerant sucked and discharged is reduced. In this compressor, since only a discharge passageway connecting the discharge chambers of the front and rear head portions are provided, the above-described limit exists.

SUMMARY OF THE INVENTION

To solve the above-described problems, it is an object of the present invention to provide a swash plate type compressor having an improved structure by which the compressed refrigerant is quickly discharged.

It is another object of the present invention to provide a swash plate type compressor by which, when refrigerant in a liquid state enters the compressor, the liquid refrigerant is quickly and effectively discharged to reduce a liquid compression noise.

It is yet another object of the present invention to provide a swash plate type compressor by which the liquid refrigerant is uniformly distributed into the front and rear head portions of the compressor so that the liquid refrigerant is quickly discharged with less resistance.

To achieve the above objects, there is provided a swash plate type compressor comprising a front head portion having a suction chamber and a discharge chamber sectioned by a partition wall formed on an inner surface of the front head portion, and having at least one upper discharge guide groove and at least one lower discharge guide groove formed in an upper portion and a lower portion of the discharge chamber, respectively, a rear head portion having a suction chamber and a discharge chamber sectioned by a partition wall formed on an inner surface of the rear head portion, and having at least one upper discharge guide groove and at least one lower discharge guide groove formed in an upper portion and a lower portion of the discharge chamber, respectively, to correspond to the upper and lower discharge guide groove of the front head portion, a cylinder installed between the front and rear head portions or inside the front and rear head portions and having a plurality of bores installed such that pistons are capable of sliding and at least one upper discharge passageway and at least one lower discharge passageway for connecting the upper and lower discharge guide grooves of the front and rear head portions, respectively, a drive shaft installed to penetrate the cylinder and rotated by a driving source, and a swash plate installed at the driving shaft to be inclined and having the pistons installed at an end portion of the swash plate.

It is preferred in the present invention that the upper discharge guide groove and the lower discharge guide groove formed at the front head portion and the rear head portion, respectively, are installed to have a phase difference from each other.

It is preferred in the present invention that a muffler portion having a suction port through which refrigerant flows in the compressor and a discharge port through which the compressed refrigerant is discharged to the outside is provided at the upper side of the swash plate type compressor, any of the front and rear head portions is connected to the discharge port of the muffler portion, and the upper discharge guide groove of the front or rear head portion connected to the discharge port is sectioned by the partition wall from the discharge chamber of the head portion to be connected by an additional transfer means.

It is preferred in the present invention that the transfer means is a through hole formed in the partition wall which sections the discharge chamber from the upper discharge guide groove of the front and rear head portion connected to the discharge chamber.

It is preferred in the present invention that the transfer means is a discharge conduit extending to the discharge chamber from the partition wall which sections the discharge chamber from the upper discharge guide groove of the front and rear head portion connected to the discharge chamber.

It is preferred in the present invention that the sum of the volumes of the discharge conduit and the discharge chamber of the head portion where the discharge conduit is formed is the same as the sum of the volumes of the discharge chamber of the head portion where the discharge conduit is not formed and the upper discharge passageway.

It is preferred in the present invention that the discharge conduit extends to a position where the length of the discharge conduit is ½ of the distance of a straight line of the discharge chamber having the discharge conduit in the lengthwise direction of the discharge conduit.

It is preferred in the present invention that the upper and lower discharge passageways are disposed in an area of the upper and lower discharge guide grooves of the front and rear head portions, respectively.

It is preferred in the present invention that a muffler portion having a suction port through which refrigerant flows in the compressor and a discharge port through which the compressed refrigerant is discharged to the outside is provided at the upper side of the swash plate type compressor, and a communication hole for connecting the upper discharge guide groove of any of the front and rear head portions and the discharge port of the muffler portion.

It is preferred in the present invention that the discharge chambers of the front and rear head portions are formed at the inner side with respect to the partition wall and the suction chambers thereof are formed at the outer side with respect to the partition wall.

It is preferred in the present invention that the upper and lower discharge guide grooves of the front and rear head portions are connected to the discharge chambers of the front and rear head portions, respectively.

To achieve the above objects, there is provided a swash plate type compressor comprising a front head portion having a suction chamber formed at the inner side with respect to a partition wall formed at an inner surface and a discharge chamber formed at the outer side with respect to the partition wall, a rear head portion having a suction chamber formed at the inner side with respect to a partition wall formed at an inner surface and a discharge chamber formed at the outer side with respect to the partition wall, and disposed to correspond to the front head portion, a cylinder installed between the front and rear head portions or inside the front and rear head portions and having a plurality of bores installed such that pistons are capable of sliding and at least two discharge passageways for connecting the suction chambers and the discharge chambers of the front and rear head portions, a drive shaft installed to penetrate the cylinder and rotated by a driving source, and a swash plate installed at the driving shaft to be inclined and having the pistons installed at an end portion of the swash plate.

It is preferred in the present invention that a muffler portion having a suction port through which refrigerant flows in the compressor and a discharge port through which the compressed refrigerant is discharged to the outside is provided at the upper side of the swash plate type compressor, and a communication hole for connecting the discharge chamber of any of the front and rear head portions and the discharge port of the muffler portion.

To achieve the above objects, there is provided a swash plate type compressor comprising, front and rear head portions, each having a suction chamber and a discharge chamber which are sectioned by a partition wall formed at an inner surface, a cylinder installed between the front and rear head portions or inside the front and rear head portions and having a plurality of bores installed such that pistons are capable of sliding and at least two discharge passageways for connecting the discharge chambers of the front and rear head portions, a drive shaft installed to penetrate the cylinder and rotated by a driving source, and a swash plate installed at the driving shaft to be inclined and having the pistons installed at an end portion of the swash plate.

It is preferred in the present invention that a muffler portion having a suction port through which refrigerant flows in the compressor and a discharge port through which the compressed refrigerant is discharged to the outside is provided at the upper side of the swash plate type compressor, and the discharge passageway disposed at the most upper portion of the discharge passageways is connected to the discharge port of the muffler portion.

It is preferred in the present invention that the discharge chambers of the front and rear head portions are formed at the inner side with respect to the partition wall and the suction chambers are formed at the outer side with respect to the partition wall.

It is preferred in the present invention that at least two discharge guide grooves connected to the discharge chambers are formed at the inner surfaces of the front and rear head portions, and the discharge guide grooves of the front and rear head portions are connected to each other by the discharge passageways.

It is preferred in the present invention that a muffler portion having a suction port through which refrigerant flows in the compressor and a discharge port through which the compressed refrigerant is discharged to the outside is provided at the upper side of the swash plate type compressor, any of the discharge guide grooves of one of the front and rear head portions is connected to the discharge port of the muffler portion, and the discharge guide groove connected to the discharge port is sectioned by the partition wall from the discharge chamber of the head portion and connected by an additional transfer means.

It is preferred in the present invention that the transfer means is a through hole formed in the partition wall which sections the discharge chamber of the head portion connected to the discharge port from the discharge guide groove.

It is preferred in the present invention that the transfer means is a discharge conduit extending to the discharge chamber from the partition wall which sections the discharge chamber of the head portion connected to the discharge port from the discharge guide groove.

It is preferred in the present invention that the sum of the volumes of the discharge conduit and the discharge chamber of the head portion where the discharge conduit is formed is the same as the sum of the volumes of the discharge chamber of the head portion where the discharge conduit is not formed and the discharge passageway connected to the discharge guide groove connected to the discharge conduit.

It is preferred in the present invention that the discharge conduit extends to a position where the length of the discharge conduit is ½ of the distance of a straight line of the discharge chamber having the discharge conduit in the lengthwise direction of the discharge conduit.

It is preferred in the present invention that the discharge chambers of the front and rear head portions are formed at the outer side with respect to the partition wall and the suction chambers are formed at the inner side with respect to the partition wall.

It is preferred in the present invention that a muffler portion having a suction port through which refrigerant flows in the compressor and a discharge port through which the compressed refrigerant is discharged to the outside is provided at the upper side of the swash plate type compressor, and a communication hole for connecting the discharge chamber of any of the front and rear head portions and the discharge port of the muffler portion.

It is preferred in the present invention that at least one of the discharge passageways is disposed at the lower side of the front and rear head portions.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
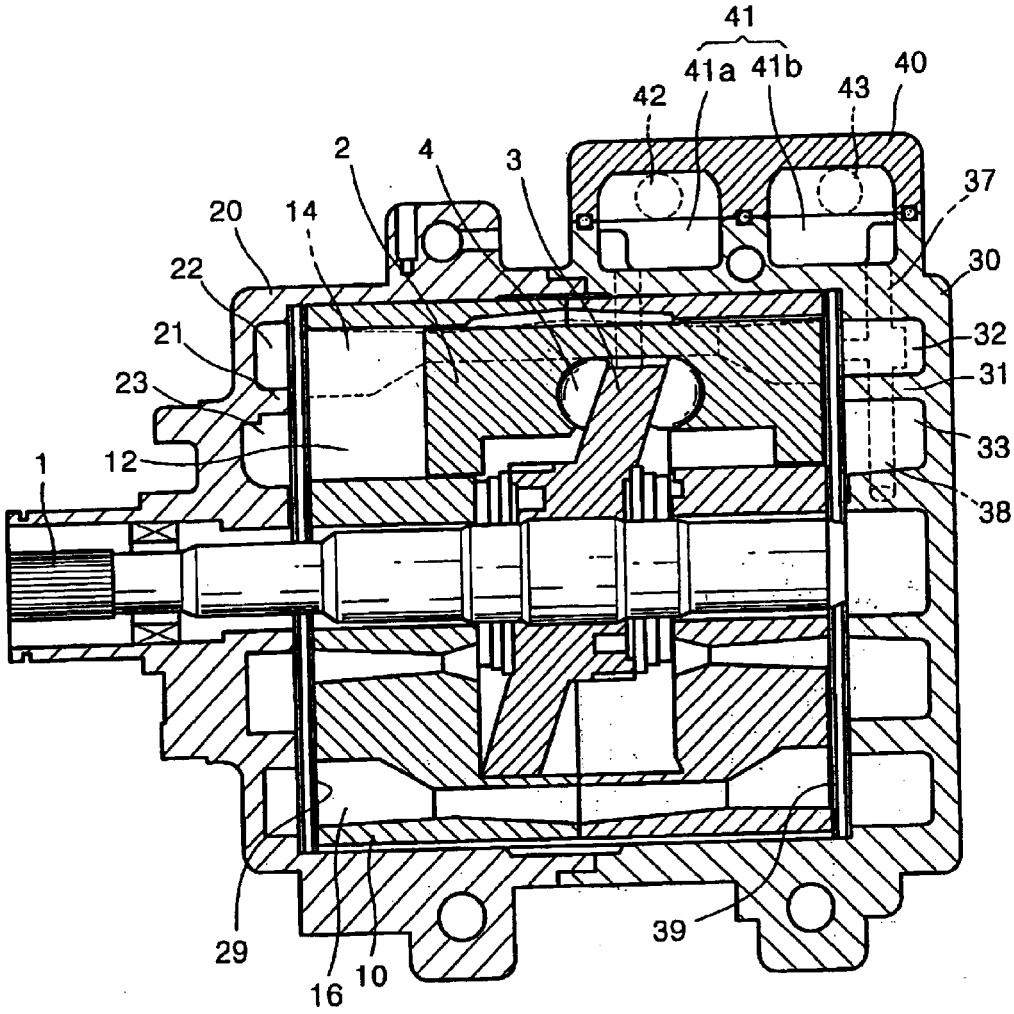
FIG. 1 is a front side sectional view of a swash plate type compressor according to a preferred embodiment of the present invention.
Figure 2:
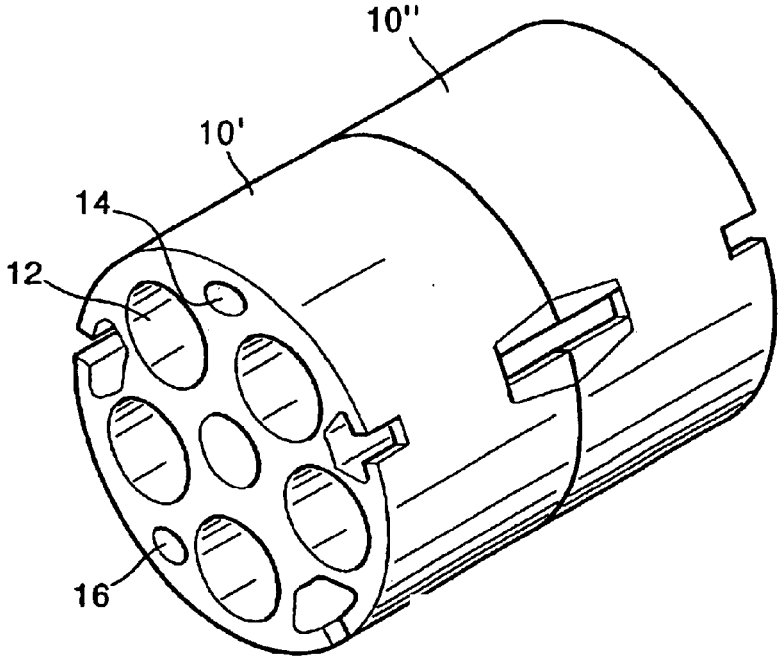
FIG. 2 is a perspective view illustrating a cylinder of FIG. 1.

Referring to FIG. 1, in a swash plate type compressor according to a preferred embodiment of the present invention, a plurality of pistons 2 are installed at a cylinder 10 and a driving shall 1 driven by a driving source (not shown) is installed at the center portion of the cylinder 10. The cylinder 10 can be formed by two cylinders 10' and 10" coupled to each other, as shown in FIG. 2. A plurality of bores 12 into which the pistons 2 are inserted and reciprocate are radially formed in the cylinder 10. Although five bores 12 are provided in the cylinders 10' and 10" according to a preferred embodiment of the present invention as shown in FIG. 2, the number of the bores 12 is not limited thereto.

In the cylinder 10, as shown in FIG. 1, the front head portion 20 and the rear head portion 30 are coupled to each other from both sides thereof to form a case. According to a preferred embodiment of the present invention, the front head portion 20 and the rear head portion 30 can be coupled in a housing method, as shown in FIG. 1. Valve apparatuses 29 and 39 in which a suction hole and a discharge hole are formed so that refrigerant can be sucked in and discharged out of the cylinder 10, are installed between the inner side surface of each of the front and rear head portions 20 and 30 and each of the both outer end portions of the cylinder 10, respectively. Any structure in which refrigerant can be sucked into the bores 12 of the cylinder 10 from suction chambers 22 and 32 of the front and rear head portions 20 and 30 and the compressed refrigerant can be discharged from the bores 12 of the cylinder 10 toward discharge chambers 23 and 33 of the front and rear head portions 20 and 30, can be adopted as the valve apparatuses 29 and 39.

A swash plate 3 is installed to be inclined at the driving shaft 1. A boss 4 installed at the central portion of the piston 2 is inserted along the edge of the swash plate 3 so that the piston 2 is connected to the swash plate 3 to be capable of being driven. Thus, the swash plate 3 is rotated as the driving shaft 1 rotates, the piston 2 reciprocates inside the cylinder 10 by the rotation of the inclined swash plate 3 and repeats suction and compression.

In the compressor having the above structure, the suction chambers 22 and 32 and the discharge chambers 23 and 33 sectioned by partition walls 21 and 31 are formed at the inner surfaces of the front head portion 20 and the rear head portion 30, respectively. The refrigerant sucked into the suction chambers 22 and 32 from a suction port 42 of a manifold portion 40 attached at the upper portion of the compressor flows into the bore 12 of the cylinder 10 through the valve apparatuses 29 and 39. The refrigerant compressed in the bores 12 of the cylinder 10 is discharged toward the discharge chambers 23 and 33 through the valve apparatuses 29 and 39 in a compressed state.

As shown in FIG. 1, when the manifold portion 40 having a muffler portion 41 is attached to the outside of the upper portion of the rear head portion 30 of the compressor, the refrigerant compressed and discharged to the discharge chamber 23 of the front head portion 20 is transferred to the rear head portion 30 and passes through a discharge portion 41*b* of the muffler portion 41 to be discharged to a discharge port 43. In contrast, when the manifold 40 is attached to the outside of the upper portion of the front head portion 20 and the refrigerant flows in from the front head portion 20 and is discharged, the refrigerant compressed and discharged to the discharge chamber 33 of the rear head portion 30 should be transferred to the front head portion 20.

Figure 3:
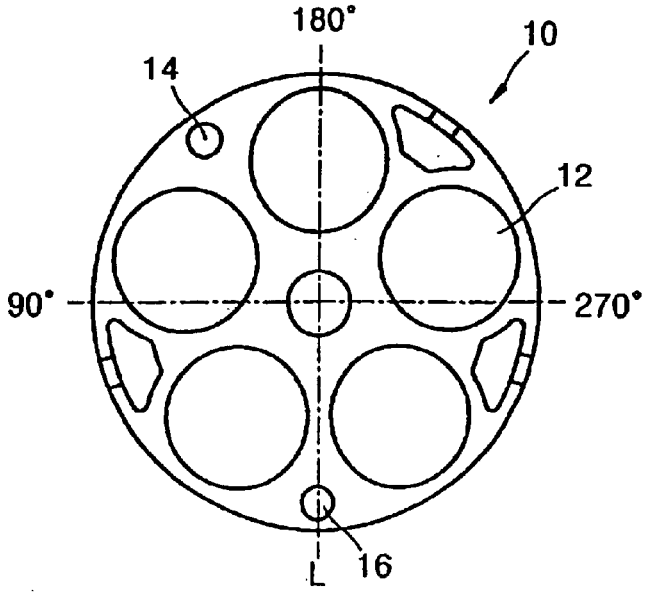
FIG. 3 is a left side view of the cylinder of FIG. 2.

The refrigerant compressed and discharged to the discharge chamber 23 of the front head portion 20 is transferred to the rear head portion 30 through at least one upper and lower discharge passageways 14 and 16 formed in the cylinder 10 in the lengthwise direction thereof. The discharge passageways connecting the discharge chambers of the front and rear head portions are formed to penetrate the cylinder 10 to be disposed between the bores 12, as shown in FIGS. 2 and 3. According to a preferred embodiment of the present invention shown in FIGS. 2 and 3, the discharge passageways 14 and 16 are formed in the upper and lower portions, respectively. Of course, a plurality of discharge passageways can be formed. Here, the upper and lower discharge passageways 14 and 16 are formed to have a phase difference, for example, a phase difference of 90° through 270°. As can be seen from FIG. 3, the upper discharge passageway 14 is disposed in a ranged of 90° through 270° with respect to a line L connecting the center of the cylinder 10 and the lower discharge passageway 16.

Figure 4:
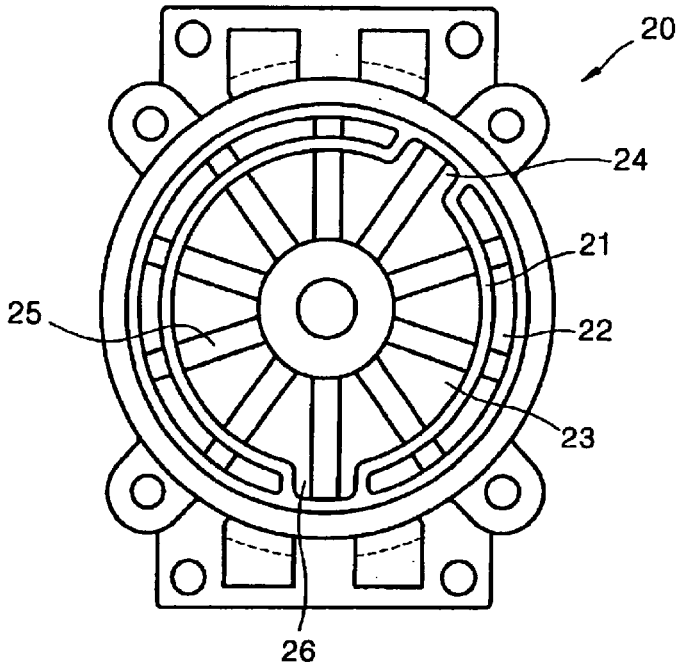
FIG. 4 is a right side view schematically illustrating the inside of the front head portion of the compressor shown in FIG. 1.
Figure 5:
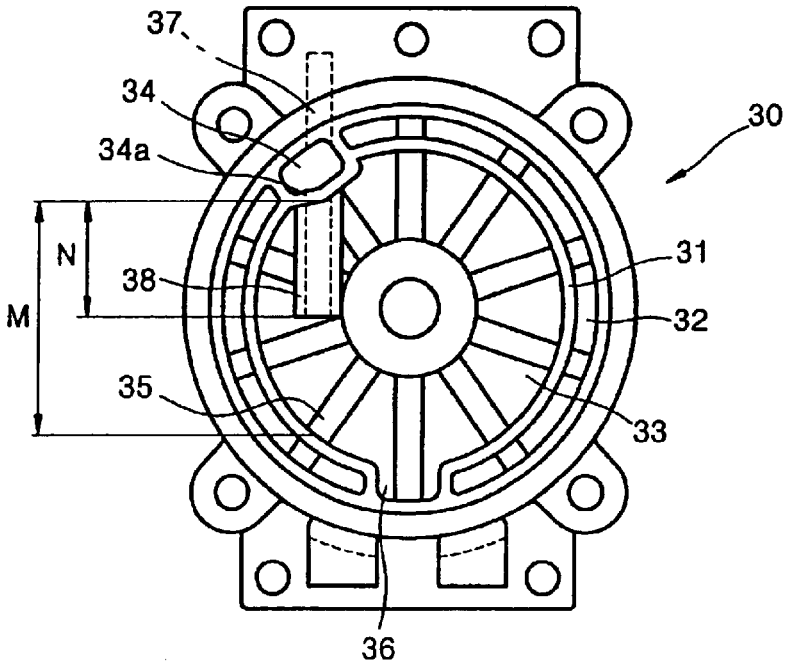
FIG. 5 is a left side view of the rear head portion having a discharge conduit, schematically illustrating the inside of the rear head portion of the compressor shown in FIG. 1.

FIGS. 4 and 5 show the structures of inner surfaces of the front and rear head portions 20 and 30, respectively. Referring to the drawings, the structures of the discharge chambers connected by the upper and lower discharge passageways 14 and 16 will be described in detail.

In FIG. 4, the inner surface of the front head portion 20 is sectioned into the suction chamber 22 and the discharge chamber 23 by the partition wall 21. The discharge chamber 23 is formed at the inner side with respect to the partition wall 21 while the suction chamber 22 is formed at the outer side thereof. A plurality of reinforcement ribs 25 are radially formed in the discharge chamber 23 and the suction chamber 22 as a reinforcing structure of the head portion.

Meanwhile, an upper discharge guide groove 24 and a lower discharge guide groove 26 are respectively formed at the upper and lower portions of the discharge chamber 23 to have a phase difference. The upper and lower discharge guide grooves 24 and 26 are connected to the discharge chamber 23. Also, the upper and lower discharge guide grooves 24 and 26 are formed at the positions corresponding to the upper and lower discharge passageways 14 and 16 shown in FIG. 3, respectively, and guide the refrigerant of the discharged chamber 23 to be discharged to the upper and lower discharge passageways 14 and 16.

FIG. 5 shows the inner surface of the rear head portion 30 arranged to correspond to the front head portion 20. As shown in FIG. 5, the rear head portion 30 is sectioned by the partition wall 31 into the discharge chamber 33 and the suction chamber 32 disposed outside the discharge chamber 33. The reinforcement ribs 35 are radially formed in the rear head portion 30. Upper and lower discharge guide grooves 34 and 36 are formed in the upper and lower portions of the rear head portion 30, respectively, to correspond to the upper and lower discharge guide grooves 24 and 26 of the front head portion 20. Accordingly, the upper discharge guide groove 24 of the front head portion 20, the upper discharge passageway 14 of the cylinder 10, and the upper discharge guide groove 34 of the rear head portion 30 are linearly connected to one another. Likewise, the lower discharge guide groove 26 of the front head portion 20, the lower discharge passageway 16 of the cylinder 10, and the lower discharge guide groove 36 of the rear head portion 30 are linearly connected to one another. Thus, the upper and lower discharge guide grooves 34 and 36 of the rear head portion 30 are disposed to have a phase difference of 90° through 270°.

As can be seen from FIG. 5, the lower discharge guide groove 36 formed in the rear head portion 30 is open to the discharge chamber 33 as in the front head portion 20. However, the upper discharge guide groove 34 of the rear head portion 30 is isolated from the discharge chamber 33 by a partition wall 34*a*, unlike the front head portion 34. The upper discharge guide groove 34 is connected to the discharge chamber 33 through an additional transfer means which will be described later. Since the lower discharge guide groove 36 is open to the discharge chamber 33, the refrigerant discharged through the lower discharge passageway 16 flows in the discharged chamber 33 through the lower discharge guide groove 36 of the rear head portion 30. Here, the refrigerant flows in the upper discharge guide groove 34 through the transfer means. A communication channel 37 is formed in fluid connection with the upper discharge guide groove 34 to be connected to the discharge port 43 of the muffler portion 41 attached to the upper portion of the compressor.

Figure 6:
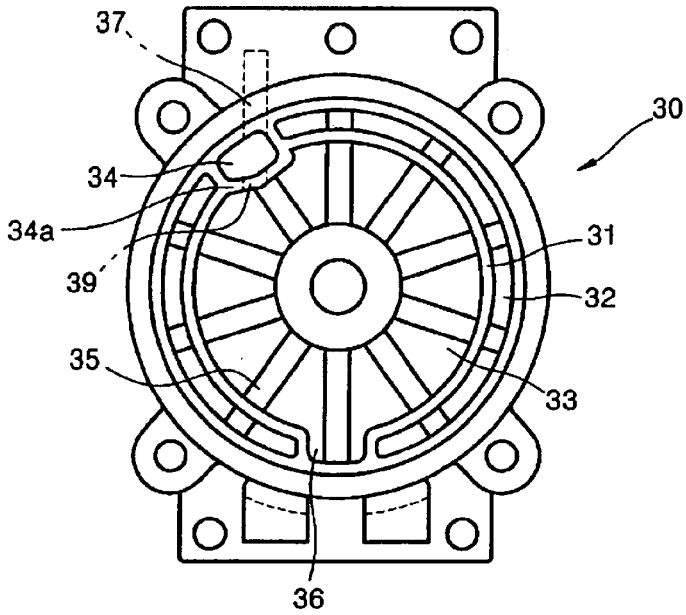
FIG. 6 is a left side view of the rear head portion having a through hole, schematically illustrating the inside of the rear head portion of the compressor shown in FIG. 1.

The transfer means, as shown in FIG. 6, can be a through hole 39 formed in the partition wall 34*a* which sections the upper discharge guide groove 34 and the discharge chamber 33, or a discharge conduit 38 as shown in FIG. 5. The lower portion of the discharge conduit 38 is open to connect the discharge chamber 33 and the upper discharge guide groove 34, which is described below in detail.

Figure 7:
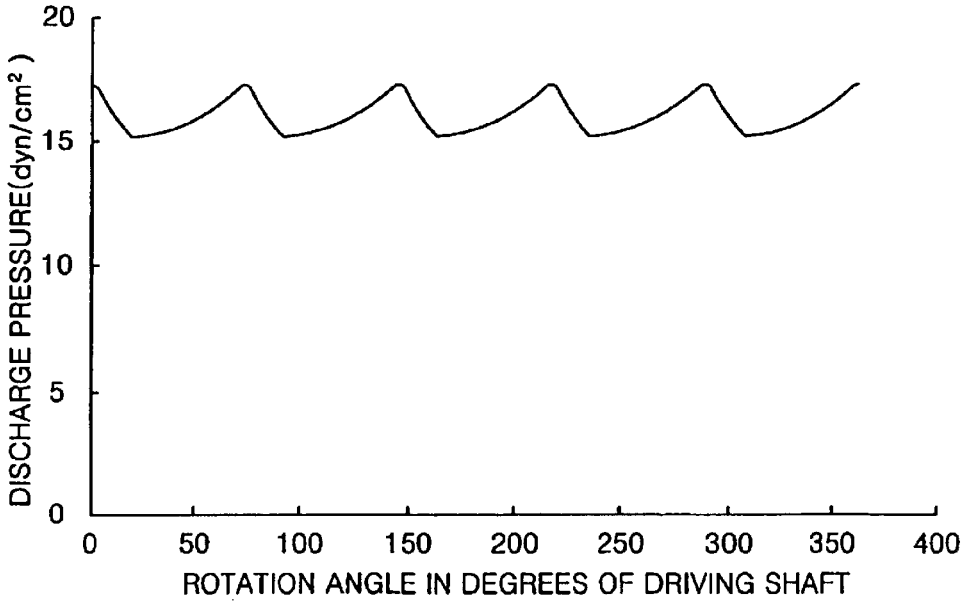
FIGS. 7 and 8 are graphs indicating the waveforms of discharge pressure of refrigerant in the discharge chambers of the front and rear head portions, respectively.
Figure 8:
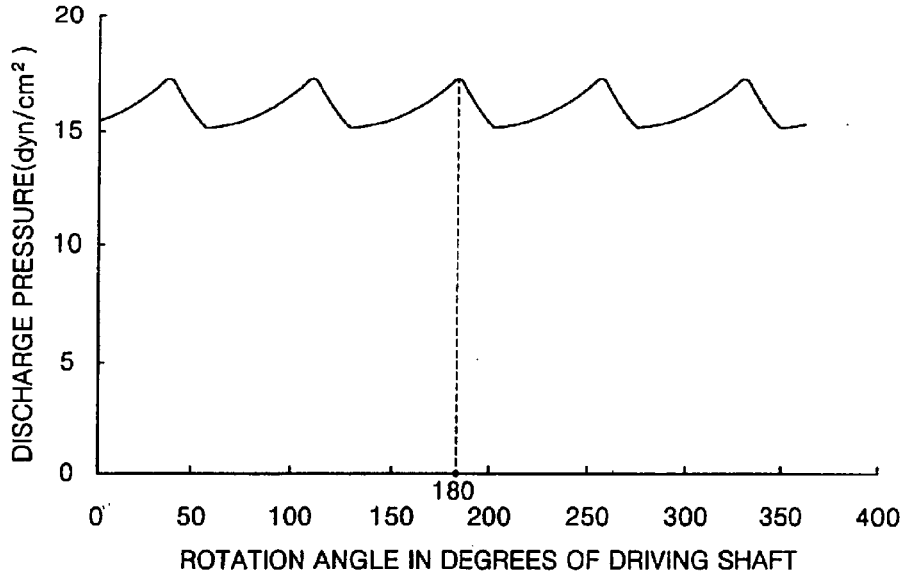

As can be seen from FIG. 1, the refrigerant discharged from the respective bores 12 to the discharge chambers 23 and 33 of the front and rear head portions 20 and 30 has a particular pressure waveform which is shown in FIGS. 7 and 8. FIGS. 7 and 8 show waveforms of pressure of the refrigerant discharged from the cylinder 10 having five bores 12, as shown in FIGS. 2 and 3, to the discharge chambers 23 and 33 of the front and rear head portions 20 and 30. As can be seen from the drawings, as the driving shaft 1 rotates, the five pistons 2 sequentially perform a compression stroke and accordingly the compression of the refrigerant is sequentially performed.

Figure 9:
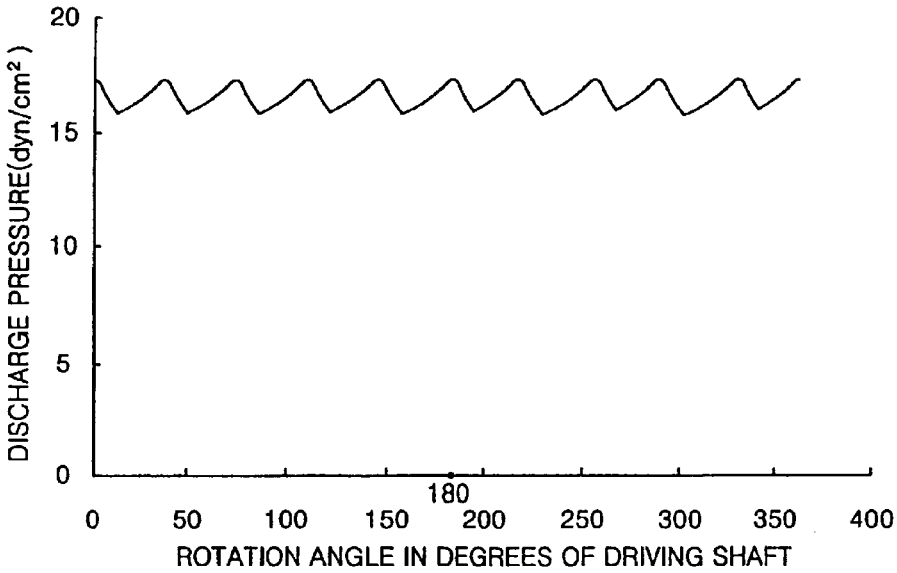
FIG. 9 is a graph indicating a state in which the waveforms of FIGS. 7 and 8 are overlapped.

As can be seen from FIGS. 7 and 8, the discharge pressure waveforms of the refrigerant discharged to the discharge chamber 23 of the front head portion 20 and the discharge chamber 33 of the rear head portion 30 are the same and have a phase difference of 180°. Thus, when the two waveforms are overlapped, as can be seen from FIG. 9, the waves are interfered with each other, causing an offset therebetween, so that the fluctuation of the waveform is remarkably reduced and accordingly pulsation noise is remarkably reduced.

To overlap the pulsation waves, spaces from the respective discharge chambers to a place where the refrigerants discharged to the discharge chambers 23 and 33 of the front and rear head portions 20 and 30 are mixed, preferably, have the same volume. That is, in the present invention, the place where the refrigerant discharged to the discharge chamber 23 of the front head portion 20 and the refrigerant discharged to the discharge chamber 33 of the rear head portion 30 are mixed together is the upper discharge guide groove 34 of the rear head portion 30 and the lower discharge guide groove 36 of the rear head portion 30, that is, the discharge chamber 33 in the FIG. 5. Thus, when the sum of the volumes of the discharge chamber 23 of the front head portion 20 and the upper discharge passageway 14 is the same as the sum of the volumes of the discharged chamber 33 of the rear head portion 30 and the discharge conduit 38 thereof, the pulsation noise can be reduced when the refrigerant discharged to the discharge chamber 33 of the front head portion 20 and the refrigerant discharged to the discharge chamber 33 of the rear head portion 30 are mixed together in the upper discharge guide groove 34 of the rear head portion 30.

To satisfy the above relationship, according to a preferred embodiment of the present invention as shown in FIG. 5, it is preferably that the length N of the discharge conduit 38 is ½ of the length M of a straight line in the lengthwise direction of the discharge conduit 38 of the discharge chamber 33. That is, the discharge conduit 38 is extended to a position where the distance from a position of the partition wall 34*a* for sectioning the upper discharge guide groove 34, from which the discharge conduit 38 begins to extend, to the inner surface of the partition wall 31 for sectioning the discharge chamber 33 and the suction chamber 32 of the rear bead portion 30 at the opposite side, is ½M.

Next, the operation of the swash plate type compressor according to the preferred embodiment of the present invention having the above structure will now be described.

First, in FIG. 1, when the compressor is operated in a normal state, that is, refrigerant in a gaseous state flows into the compressor, the refrigerant flows into the suction chambers 22 and 32 of the front and rear head portions 20 and 30 from the suction port 42 provided at the suction portion 41a of the muffler portion 41. When the swash plate 3 is rotated according to the rotation of the driving shaft 1, the piston 2 reciprocates in the cylinder 10. When the piston 2 performs a suction stroke, the refrigerant in the suction chambers 22 and 32 of the front and rear head portions 20 and 30 are sucked into the cylinder 10. According to the compression stroke of the piston 2, the refrigerant pass through the valve apparatuses 29 and 39 and are discharged to the discharge chambers 23 and 33. Here, the suction and compression in the front head portion 20 are alternatively performed with the suction and in the rear head portion 30.

The refrigerant discharged to the discharge chamber 23 of the front head portion 20 flows in the upper and lower discharge guide grooves 24 and 26 formed in the upper and lower portions thereof (please refer to FIG. 4) and then flows in the upper and lower discharge guide grooves 34 and 36 of the rear head portion 30 through the upper and lower discharge passageways 14 and 16 in the cylinder 10 (please refer to FIG. 5). Here, the refrigerant flowing in the upper discharge guide groove 34 of the rear bead portion 30 via the upper discharge passageway 14 is discharged to the discharge port 43 via the communication channel 37 and the discharge portion 41*b* of the muffler portion 41. The refrigerant flowing in the lower discharge guide groove 36 of the rear head portion 30 via the lower discharge passageway 16 flows in the discharge chamber 33 of the rear head portion 30. Here, the refrigerant is transferred to the upper discharge guide groove 34 through the transfer means such as the discharge conduit 38 of FIG. 5 or the through hole 39 of the FIG. 6, together with the refrigerant discharged to the discharge chamber 33 of the rear head portion 30, and is discharged to the discharge portion 41*b* of the muffler portion 41 via the communication channel 37.

As described above, when refrigerant in a liquid state is sucked in the compressor, the liquid refrigerant should be discharged quickly out of the compressor. However, since the refrigerant in a liquid state sinks to the lower portion of the discharge chamber due to the weight thereof unlike the refrigerant in a gaseous state, the refrigerant in a liquid state is not effectively discharged with only the discharge passageway formed in the upper portion as in the convention compressor. Also, in the structure in which the discharge passageway is formed only in the upper portion according to the conventional technology, since the refrigerant in the liquid state flows in the rear head portion of the compressor, the liquid refrigerant gathers in the rear head portion so that a great compression resistance is exerted during the compression.

That is, when a daily temperature range is great, refrigerant in a liquid state flows in the compressor and is compressed in the cylinder 10, the liquid refrigerant discharged to the discharge chamber 23 of the front hear portion 20 flows in the lower discharge guide groove 26 of the lower portion of the discharge chamber 23 and passes through the lower discharge passageway 16 of the cylinder 10 connected thereto. The liquid refrigerant flows in the lower discharge guide groove 36 of the rear head portion 30 and enters the discharged chamber 33 of the rear head portion 30. Here, the refrigerant flows in the upper discharge guide groove 34 by the transfer means, together with the liquid refrigerant discharged to the discharge chamber 33 of the rear head portion 30, and is discharged to the discharge port 43 via the discharge portion 41*b* of the muffler portion 41 through the communication channel 37. The above quick discharge of the liquid refrigerant can reduce noise due to the compression of the liquid refrigerant.

In addition, since the sucked liquid refrigerant can be uniformly distributed to the front and rear head portions 20 and 30 through the lower discharge passageway 16, the compression resistance during the compression of the liquid refrigerant is small and the refrigerant can be quickly discharged with smaller resistance.

In the above-described preferred embodiment, the muffler portion is attached at the upper portion of the rear head portion and the refrigerant discharged to the front head portion is discharged to the rear head portion. However, this is a matter of design which can be modified according to the position of the installation of the muffler portion. That is, when the muffler portion is provided at the upper portion of the front head portion of the compressor and the refrigerant flows into the compressor from the front head portion. When the refrigerant is discharged, the refrigerant discharged to the discharge chamber of the rear head portion is discharged to the discharge chamber of the front head portion via the upper and lower discharge passageways of the cylinder connected thereto, contrary to the above description. Here, the refrigerant is discharged to the muffler portion via the upper discharge guide groove of the front head portion. Here, the upper discharge guide groove of the front head portion is sectioned from the discharge chamber of the front head portion by the partition wall. Thus, the refrigerant in the discharge chamber is discharged to the upper discharge guide groove of the front head portion via the transfer means so that the refrigerant can be discharged through the communication hole connected to the muffler portion.

Figure 10:
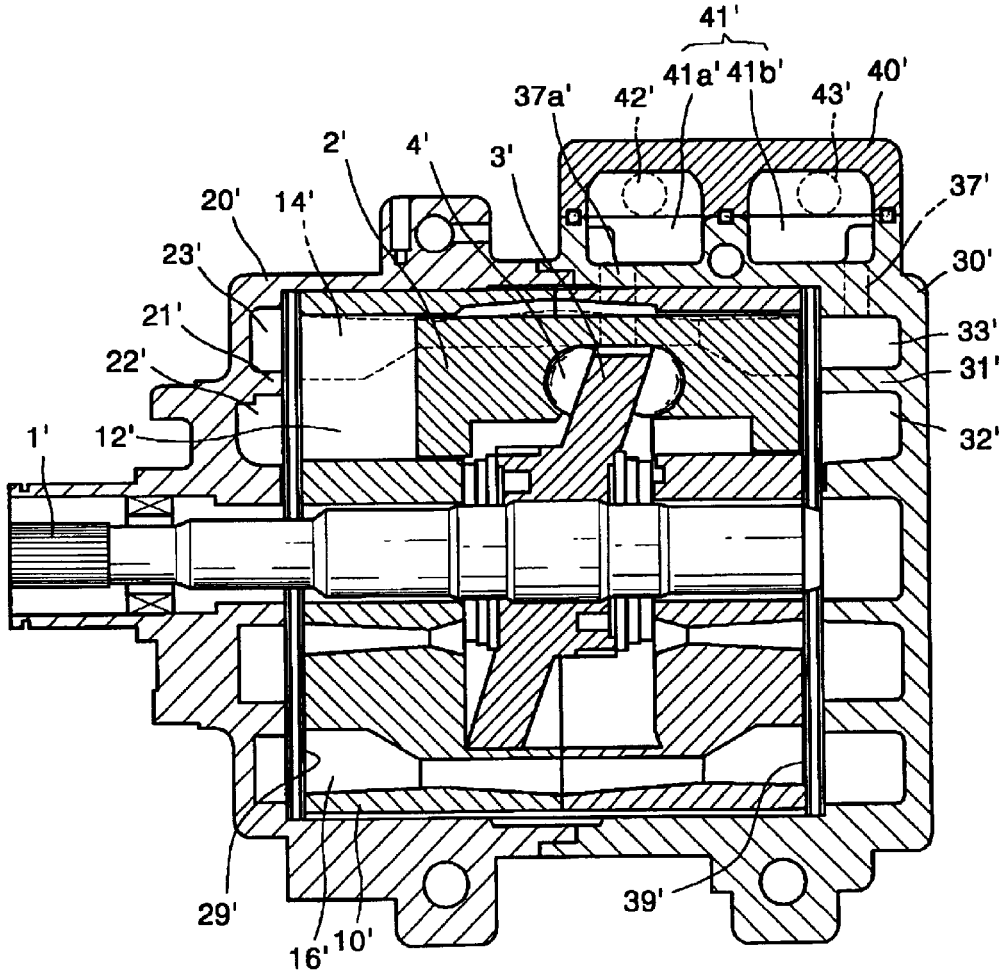
FIG. 10 is a front side sectional view illustrating a swash plate type compressor according to another preferred embodiment of the present invention.
Figure 11:
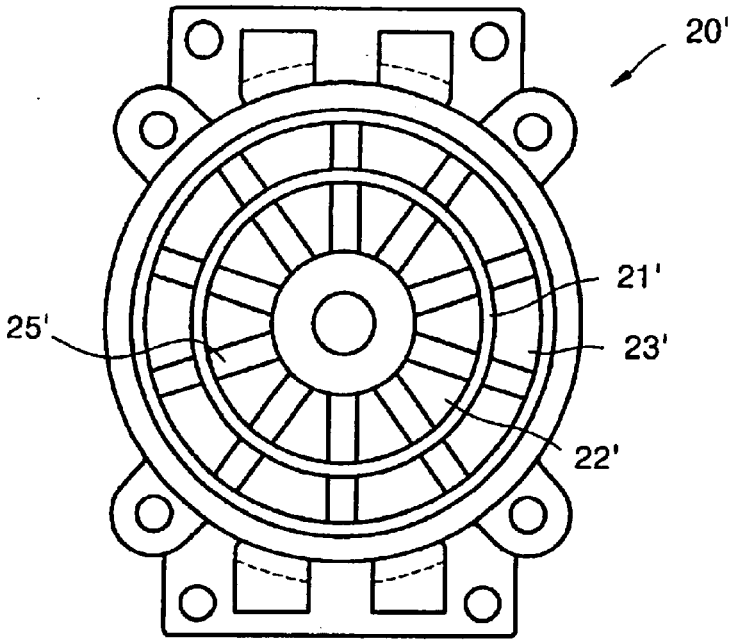
FIG. 11 is a right side view schematically illustrating the inside of the front head portion of the compressor shown in FIG. 10.
Figure 12:
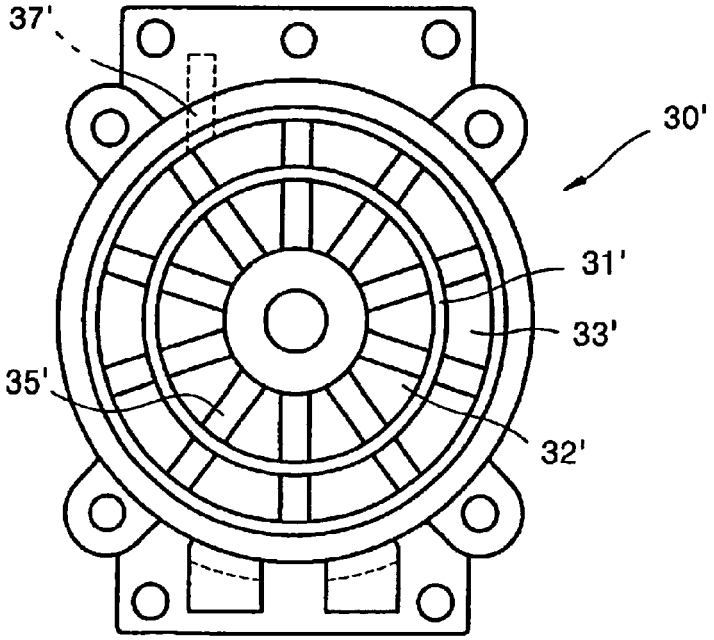
FIG. 12 is a left side view schematically illustrating the inside of the rear head portion of the compressor shown in FIG. 10.

In a awash plate type compressor according to another preferred embodiment of the present invention, a suction chamber and a discharge chamber are formed at the inner side and the outer side, respectively, with respect to a partition wall. That is, as can be seen from FIGS. 10 through 12, a suction chamber 22' is formed at the inner side with respect to a partition wall 21' at the inner surface of a front head portion 20' and a discharge chamber 23' is formed at the outer side thereof. A suction chamber 32' and a discharge chamber 33' are formed at the inner side and the outer side with respect to the partition wall 31' at the inner surface of a rear head portion 30'. In the above swash plate type compressor having the above structure, the refrigerant is sucked from the suction portion 41*a*' of the muffler portion 41' to a swash plate chamber (not shown) where the swash plate 3 is installed, through an additional communication channel 37*a*', and is guided to the suction chambers 22' and 32' of the front and rear head portions 20' and 30' through a plurality of flow channels (not shown) formed in the cylinder 10'.

Also, in the above-described structure, the refrigerant discharged to the discharge chamber 23' outside the partition wall 21' of the front head portion 20' is directly discharged to the discharge chamber 33' of the rear head portion 30' through a lower discharge passageway 16' formed in a cylinder 10' by penetrating the same. Here, the refrigerant is discharged to a discharge portion 41*b*' of a muffler portion 41' provided at the upper portion of the rear head portion 30' via a communication channel 37'. Of course, when the muffler portion 41' is disposed at the upper portion of the front head portion 30', the refrigerant discharged to the discharge chamber 33' of the rear head portion 30' is discharged to the front head portion 20'.

Thus, the above-described compressor does not need to have an additional discharge guide groove for connecting the discharge chamber and the discharge passageway as in the above-described preferred embodiment. This is because, as can be seen from FIGS. 11 and 12, since the discharge chambers 23' and 33' are disposed at the outer side of the front and rear head portions 20' and 30', the discharge chambers 23' and 33' can be directly connected to the lower discharge passageway 16' in the cylinder 10'.

In addition to the above structure, the discharge chamber and the discharge passageway can be connected without the discharge guide groove by making the boundary between the discharge chamber and the suction chamber different.

Figure 13:
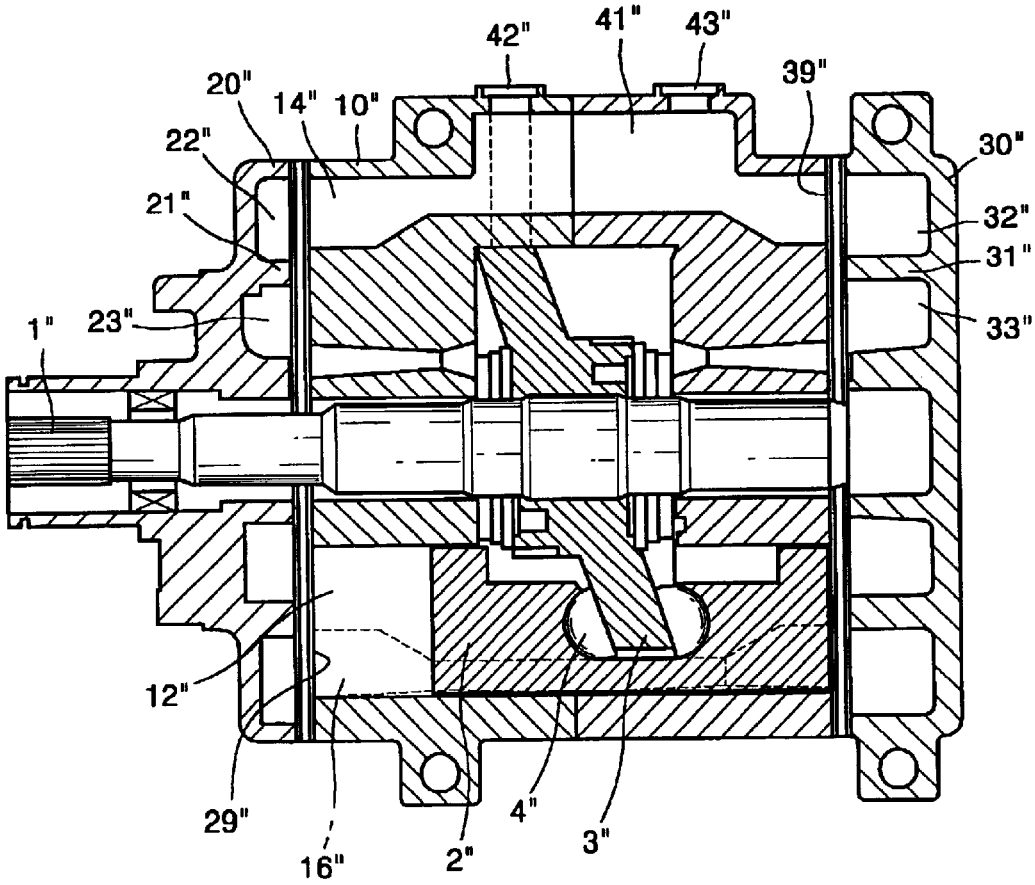
FIG. 13 is a front side sectional view illustrating a swash plate type compressor according to yet another preferred embodiment of the present invention.

Although the above-described preferred embodiment concerns a compressor having the front and rear head portions coupled in a method of enclosing the cylinder from the front and rear sides, respectively, the technical concept of the present invention can be applied not only to the above housing type compressor, but also equally to a header type compressor in which a cylinder is exposed to the outside and the front and rear head portions are coupled from the front and rear sides of the cylinder. That is, as shown in FIG. 13, the technical concept of the present invention can be equally applied to a swash plate type compressor in which a cylinder 10" exposed to the outside is installed between a front head portion 20" and a rear head portion 30", both being of a header type, and a muffler portion 41" is formed at the upper portion of the cylinder 10". In the swash plate type compressor having the above structure, an upper discharge passageway 14" can be directly connected to the muffler portion 41" so that refrigerant can be directly discharged through a discharge port 43". Detailed descriptions of other structures in the present preferred embodiment will be omitted because they are the same as those shown in FIG. 1.

The swash plate type compressor according to the present invention having the above-described structure has the following effects.

First, since the unit for connecting the front head portion and the rear head portion is provided further, the compressed refrigerant can be quickly discharged.

Second, since the discharge passageway connecting the front head portion and the rear head portion in the lower portion is provided further, when the liquid refrigerant flows in the compressor, the compressed liquid refrigerant can be quickly discharged so that noise due to the compression of the liquid refrigerant can be reduced.

Third, the liquid refrigerant can be uniformly distributed throughout the front and rear head portions by the lower discharge passageway so that less compression resistance exists. Also, the noise due to the compression can be reduced since the liquid refrigerant can be quickly discharged.

Fourth, the pulsation noise of the refrigerant can be reduced by appropriately designing the volumes of the respective discharge chambers of the front and rear head portions and the discharge passageways and the volume of the discharge conduit used as the transfer means.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A swash plate type compressor, comprising:

a front head portion having a suction chamber and a discharge chamber separated from each other by a first partition wall formed on an inner surface of the front head portion, and at least one upper discharge guide groove and at least one lower discharge guide groove formed in an upper portion and a lower portion of the discharge chamber, respectively;

a rear head portion having a suction chamber and a discharge chamber separated from each other by a second partition wall formed on an inner surface of the rear head portion, and at least one upper discharge guide groove and at least one lower discharge guide groove formed in an upper portion and a lower portion of the discharge chamber, respectively, to correspond to the upper and lower discharge guide grooves of the front head portion, respectively;

a cylinder installed between the front and rear head portions and having a plurality of bores for receiving therein a number of slidable pistons, at least one upper discharge passageway providing fluid connection between the upper discharge guide grooves of the front and rear head portions, and at least one lower discharge passageway providing fluid connection between the lower discharge guide grooves of the front and rear head portions;

a drive shaft installed to penetrate the cylinder and rotatable by a driving source; and an inclined swash plate installed on the drive shaft and having the pistons installed at an end portion of the swash plate.

2. The swash plate type compressor as claimed in claim 1, wherein the upper discharge guide groove and the lower discharge guide groove formed in any of the front head portion and the rear head portion, respectively, are positioned to have a phase difference from each other.

3. The swash plate type compressor as claimed in claim 1, further comprising a muffler portion provided at an upper side of the compressor and having a suction port through which refrigerant flows into the compressors, and a discharge port through which the compressed refrigerant is discharged to an outside of the compressor, wherein any of the front and rear head portions is in fluid connection with the discharge port of the muffler portion, and the upper discharge guide groove of the rear head portion is in fluid connection with the discharge port, is separated by a third partition wall from the discharge chamber of the rear head portion, and is in fluid connection with the discharge chamber of the rear head portion via an additional fluid transfer element.

4. The swash plate type compressor as claimed in claim 3, wherein the transfer element is a through hole formed in the third partition wall which separates the discharge chamber from the upper discharge guide groove of the rear head portion.

5. The swash plate type compressor as claimed in claim 3, wherein the transfer element is a discharge conduit extending into the discharge chamber from the third partition wall which separates the discharge chamber from the upper discharge guide groove of the rear head portion.

6. The swash plate type compressor as claimed in claim 5, wherein a sum of the volumes of the discharge conduit and the discharge chamber of the rear head portion is the same as a sum of the volumes of the discharge chamber of the front head portion and the upper discharge passageway.

7. The swash plate type compressor as claimed in claim 5, wherein the discharge conduit extends from the third partition wall in a longitudinal direction of said discharge conduit and terminates at a point which is equally spaced, in said longitudinal direction, from said third partition wall and said second partition wall.

8. The swash plate type compressor as claimed in claim 1, wherein both ends of the upper and lower discharge passageways are disposed in vicinity of the upper and lower discharge guide grooves of the front and rear head portions, respectively.

9. The swash plate type compressor as claimed in claim 1, further comprising a muffler portion provided at an upper side of the compressor and having a suction port through which refrigerant flows into the compressors, and a discharge port through which the compressed refrigerant is discharged to an outside of the compressor, and a communication channel providing fluid connection between the upper discharge guide groove of the rear head portion and the discharge port of the muffler portion.

10. The swash plate type compressor as claimed in claim 1, wherein the discharge chamber of the front head portion is formed at an inner side with respect to the first partition wall and the suction chamber of the front head portion is formed at an outer side with respect to the first partition wall; and the discharge chamber of the rear head portion is formed at an inner side with respect to the second partition wall and the suction chamber of the rear head portion is formed at an outer side with respect to the second partition wall.

11. The swash plate type compressor as claimed in claim 10, wherein the upper and lower discharge guide grooves of the front and rear head portions are in fluid connection with the discharge chambers of the front and rear head portions, respectively.

12. A swash plate type compressor, comprising:

front and rear head portions, each having a suction chamber and a discharge chamber which are separated from each other by a partition wall formed on an inner surface of said head portion;

a cylinder installed between the front and rear head portions and having a plurality of bores for receiving therein a number of slidable pistons, and at least two discharge passageways located in upper and lower portions of the cylinder, respectively, and providing fluid connection between the discharge chambers of the front and rear head portions;

a drive shaft installed to penetrate the cylinder and rotatable by a driving source; and an inclined swash plate installed on the drive shaft and having the pistons installed at an end portion of the swash plate.

13. The swash plate type compressor as claimed in claim 12, further comprising a muffler portion provided at an upper side of the compressor and having a suction port through which refrigerant flows into the compressor, and a discharge port through which the compressed refrigerant is discharged to an outside of the compressor;

wherein a discharge passageway disposed at a most upper portion of said at least two discharge passageways is in fluid connection with the discharge port of the muffler portion.

14. The swash plate type compressor as claimed in claim 12, wherein, in each of the front and rear head portions, the discharge chamber is formed at an inner side with respect to the partition wall and the suction chamber is formed at an outer side with respect to the partition wall.

15. The swash plate type compressor as claimed in claim 14, wherein at least two discharge guide grooves in fluid connection with the discharge chambers are formed on the inner surfaces of the front and rear head portions, and the discharge guide grooves of the front and rear head portions are in fluid connection with each other via the discharge passageways.

16. The swash plate type compressor as claimed in claim 15, further comprising a muffler portion provided at an upper side of the compressor and having a suction port through which refrigerant flows into the compressors, and a discharge port through which the compressed refrigerant is discharged to an outside of the compressor;

wherein the discharge guide groove of the rear head portion is in fluid connection with the discharge port of the muffler portion, is separated by a further partition wall from the discharge chamber of the rear head portion, and is in fluid connection with the discharge chamber of the rear head portion via an additional fluid transfer element.

17. The swash plate type compressor as claimed in claim 16, wherein the transfer element is a through hole formed in the further partition wall which separates the discharge chamber of the rear head portion from the discharge guide groove.

18. The swash plate type compressor as claimed in claim 16, wherein the transfer element is a discharge conduit extending into the discharge chamber from the further partition wall which separates the discharge chamber of the rear head portion from the discharge guide groove.

19. The swash plate type compressor as claimed in claim 18, wherein a sum of the volumes of the discharge conduit and the discharge chamber of the rear head portion is the same as a sum of the volumes of the discharge chamber of the head portion and a discharge passageway in fluid connection with the discharge guide groove that is in fluid connection with the discharge conduit.

20. The swash plate type compressor as claimed in claim 18, wherein the discharge conduit extends from said further partition wall in a longitudinal direction of said discharge conduit and terminates at a point which is equally spaced, in said longitudinal direction, from said further partition wall and the partition wall that separates the suction chamber and the discharge chamber of the rear head portion.

21. The swash plate type compressor as claimed in claim 12, wherein, in each of the front and rear head portions, the discharge chamber is formed at an outer side with respect to the partition wall and the suction chamber is formed at an inner side with respect to the partition wall.

22. The swash plate type compressor as claimed in claim 21, further comprising:

a muffler portion provided at an upper side of the compressor and having a suction port through which refrigerant flows into the compressor, and a discharge port through which the compressed refrigerant is discharged to an outside of the compressor;

a communication channel providing fluid connection between the discharge chamber of any of the front and rear head portions and the discharge port of the muffler portion.

23. The swash plate type compressor as claimed in claim 12, wherein at least one of the discharge passageways is disposed at a lower side of the front and rear head portions.

* * * * *